US009016735B2

(12) United States Patent
Lesueur et al.

(10) Patent No.: US 9,016,735 B2
(45) Date of Patent: Apr. 28, 2015

(54) HANDLE FOR AN OPENABLE BODY SECTION OF A VEHICLE, INCLUDING A SAFETY DEVICE

(75) Inventors: Guillaume Lesueur, Creteil Cedex (FR); Massimo Frattini, Pianezza (IT)

(73) Assignee: VALEO S.p.A., Santena (IT)

( * ) Notice: Subject to any disclaimer, the term of this patent is extended or adjusted under 35 U.S.C. 154(b) by 0 days.

(21) Appl. No.: 13/643,152

(22) PCT Filed: Apr. 20, 2011

(86) PCT No.: PCT/EP2011/056365

§ 371 (c)(1),
(2), (4) Date: Apr. 8, 2013

(87) PCT Pub. No.: WO2011/134874

PCT Pub. Date: Nov. 3, 2011

(65) Prior Publication Data

US 2013/0187394 A1 Jul. 25, 2013

(30) Foreign Application Priority Data

Apr. 27, 2010 (IT) ..... MI2010A0723

(51) Int. Cl.

| | |
|---|---|
| ***E05B 3/00*** | (2006.01) |
| ***E05B 85/10*** | (2014.01) |
| ***E05B 77/06*** | (2014.01) |
| ***E05B 85/16*** | (2014.01) |
| *E05B 13/00* | (2006.01) |

(52) U.S. Cl.

CPC ..... *E05B 85/10* (2013.01); *E05B 13/002* (2013.01); *E05B 77/06* (2013.01); *E05B 85/16* (2013.01); *Y10S 292/31* (2013.01)

(58) Field of Classification Search

USPC ..... 292/335.3, DIG. 31

See application file for complete search history.

(56) References Cited

U.S. PATENT DOCUMENTS

| | | | | |
|---|---|---|---|---|
| 2,219,626 | A | 10/1940 | Johnson | |
| 7,152,893 | B2 * | 12/2006 | Pudney | 292/336.3 |
| 7,431,357 | B2 * | 10/2008 | Pudney | 292/336.3 |
| 2003/0001399 | A1 * | 1/2003 | Sato | 292/336.3 |
| 2007/0080547 | A1 * | 4/2007 | Lee | 292/336.3 |
| 2007/0294861 | A1 | 12/2007 | Cummins et al. | |

FOREIGN PATENT DOCUMENTS

| | | | |
|---|---|---|---|
| DE | 196 42 698 | A1 | 4/1998 |
| EP | 1 556 569 | A1 | 7/2005 |
| EP | 1 586 726 | A1 | 10/2005 |
| EP | 1 950 366 | A2 | 7/2008 |
| GB | 2462471 | A | 2/2010 |
| WO | 2010/069787 | A1 | 6/2010 |

OTHER PUBLICATIONS

International Search Report w/translation issued in PCT/EP2011/056365 mailed Jul. 15, 2011 (6 pages)

* cited by examiner

*Primary Examiner* — Mark Williams
(74) *Attorney, Agent, or Firm* — Osha Liang LLP

(57) ABSTRACT

The invention relates to a handle (2) for an openable body section of a vehicle, including: an actuator (20) such as a lever, which is movably mounted between an inoperative position of the actuator and a position for unlocking the openable body section, and a locking member (36), such as a lock bolt, which is designed to occupy an inoperative position in which same locks the actuator (20) in the inoperative position of the actuator.

9 Claims, 2 Drawing Sheets

HANDLE FOR AN OPENABLE BODY SECTION OF A VEHICLE, INCLUDING A SAFETY DEVICE

The invention relates to motor vehicle door handles.

Vehicle door handles equipped with an inertial-mass safety device which, in the event of an accident, prevent the door from opening under the effect of the deceleration experienced by the graspable part of the handle, are known. Document EP-1 556 569 thus discloses a pendulum mechanism which allows the door to be unlocked and opened when the user grasps hold of the graspable part of the external handle but which prevents this opening under the effect of the unwanted deceleration of the graspable part of the handle, a flyweight of the pendulum indeed through inertia causing the pendulum to be placed in a safety door-locking position.

Inertial-mass safety devices do, however, have their disadvantages. They require in-depth calculations for sizing the flyweight. In addition, they make the development of new vehicle handles more complicated. These mechanism also lengthen the time taken to assemble the handle and make it more difficult to standardize this handle for incorporation into various projects.

This is why vehicle door safety devices that do not have an inertial mass mechanism have been proposed. Such for example is the subject matter of document EP 1 950 366. In the latter, the graspable part of the handle comprises a catch which, for opening, causes two elements of the door unlocking drive train to engage with one another. Thus, when the user seizes hold of the graspable part of the handle, he brings the elements of the drive train into engagement and this allows the door to be unlocked and opened. In the event of a collision involving the vehicle, even if the graspable part of the handle moves through an inertial effect, the catch is not actuated. As the components are not engaged with one another, the drive train remains interrupted which means that the movement of the graspable part of the handle occurs without unlocking the door.

It is an object of the invention to propose a handle of a different type but which can likewise be free of any inertial mass.

To this end, the invention provides a vehicle door handle, which comprises:

- an actuator, such as a lever, which is mounted such that it can move between an actuator rest position and a door unlocking position, and
- a blocking member, such as a bolt, which is arranged so as to occupy a rest position in which it blocks the actuator in the actuator rest position.

Thus, unlike the principle adopted in document EP 1 950 366, safety is afforded not by interrupting the drive train in the rest position but through the fact that this drive train is immobilized, by the blocking of the actuator, in the rest position. When the time comes to unlock the door, the blocking of the actuator is terminated so that the drive train can act in the normal way. This arrangement likewise makes it possible to dispense with the need for an inertial mass. Further, it can be produced in a fairly compact and easy to assemble form. It operates reliably under all circumstances and can readily be standardized for fitting to various projects.

The handle according to the invention may further exhibit at least any one of the following features:

- the handle is arranged such that, in the rest position, the blocking member enters the actuator, in particular a circumferential face of the latter;

- the blocking member is mounted such that it can slide, for example in a direction at right angles to a rotational axis of the actuator;
- the sliding direction is horizontal;
- the sliding direction is perpendicular to a general plane of contact between a graspable part of the handle and the door;
- the handle comprises a graspable part of the handle which is able to directly control the actuator;
- the handle is arranged such that the graspable part of the handle is engaged with the actuator in any position of the graspable part of the handle and of the actuator;
- the handle comprises an unblocking control member which is able to move the blocking member out of its rest position;
- it comprises a graspable part of the handle having a window in which the unblocking control member extends; and
- it, for unlocking, comprises a cable, which is actuated by the actuator, for transmitting an unlocking command.

Other features and advantages of the invention will become further apparent from the following description of one embodiment which is given by way of nonlimiting example with reference to the attached drawings in which.

Figure 1:
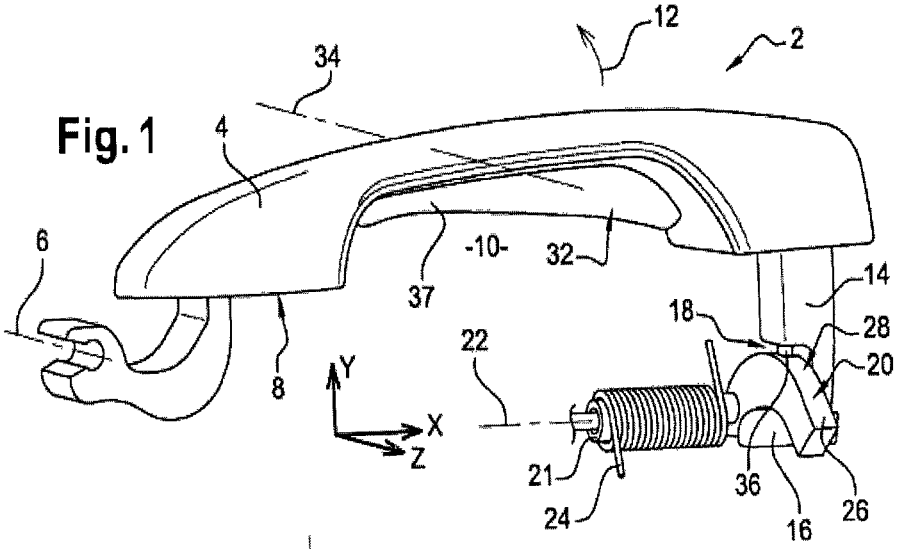
FIG. 1 is a perspective view showing a number of components of a handle according to one embodiment of the invention, the handle being at rest.
Figure 2:
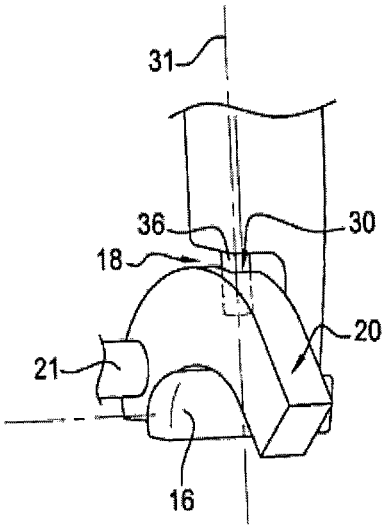
FIG. 2 is a view on a larger scale of part of the handle of FIG. 1.

The figures illustrate a handle 2 for a door of a land motor vehicle such as a passenger car. The door is, for example, a front side door providing access to the passenger compartment so that somebody can get into it. The orthogonal frame of reference X, Y, Z is used in what follows, X denoting the horizontal longitudinal direction of the vehicle corresponding to its direction of travel, Y corresponding to the transverse horizontal direction and Z corresponding to the vertical direction. The door extends mainly in the X and Z directions.

The handle 2 comprises an external graspable part of the handle 4 intended to be operated directly by a user from outside the door in order to unlock the latter and open it.

The graspable part of the handle 4 is of a shape that is elongate in the X direction. The graspable part of the handle has, facing the door, an internal face 8 of flat shape substantially corresponding to the external face of the door and extending chiefly in a plane parallel to the X and Z directions. The face 8 is hollowed so as to create in the graspable part of the handle a window 10 that passes right through this handle in the Z direction and gives the graspable part of the handle the overall shape of an arch that is flattened in the Y direction. The graspable part of the handle 4 is mounted such that it can rotate on a supporting structure of the handle or of the door about a vertical axis 6 in this instance situated at the end of the graspable part of the handle that lies furthest to the rear in the X direction and with reference to the direction of travel of the vehicle. To unlock the door, the user causes the graspable part of the handle to turn in the direction of arrow 12 to pull it away from the door. The graspable part of the handle 4 is illustrated in its rest position in the figures, it being returned to that position by means of a return spring that has not been depicted.

The graspable part of the handle 4, at its opposite longitudinal end to the axis 6, has an arm 14 that is elongate in the Y direction toward the door. This arm is of one piece with the main external body of the graspable part of the handle and at its free end has a hook 16 formed by a continuation of this end in the X direction toward the axis X and by a cavity 18.

The handle 2 further comprises an unlocking actuator 20 in the form of a transmission lever mounted such that it can rotate with respect to the supporting structure of the handle and of the door about an axis 22 which, in this instance, is horizontal and parallel to the X direction. The lever 20 is mounted such that it can move between a rest position, illustrated in the figures, in which it does not command unlocking, and an active position in which it commands unlocking. The lever 20 is returned to the rest position by means of a spring 24, in this instance a coil spring coaxial with the axis 22, resting firstly against the lever and secondly against the supporting structure.

The handle comprises a cable, not illustrated, by means of which the lever is connected, downstream of the handle drive train, to the other members thereof so that the cable can transmit an unlocking command originating from the lever.

The lever 20 comprises a continuation 26 extending from a core 21 of the lever in an arc of a circle situated in a plane parallel to the Y and Z directions and having an axis 33 parallel to the axis 22. This continuation forms a hook engaged in the hook belonging to the arm 14 and in the cavity 18.

The continuation 26 has a circumferential face 28 in the shape of a cylinder of circular cross section in a plane perpendicular to the X direction. This face has an orifice 30 of cylindrical shape extending along an axis 31 that is radial with respect to the axis 23 and parallel to the Y direction.

The handle 2 further comprises an unblocking control member 32 part of which extends into the graspable part of the handle 4 and the other part of which extends into the window 10, being visible therein in the figures. This unblocking control member 31 here forms a catch. The catch is mounted so that it can rotate, with respect to the graspable part of the handle 4, about a vertical axis 34. The catch 32 is illustrated in the rest position in FIG. 1 and in the unblocking position in FIG. 3. It is returned to the rest position by means of a return spring that has not been illustrated. It projects further beyond the graspable part of the handle 4 and into the window 10 in its rest position than it does in its unblocking position.

Figure 3:
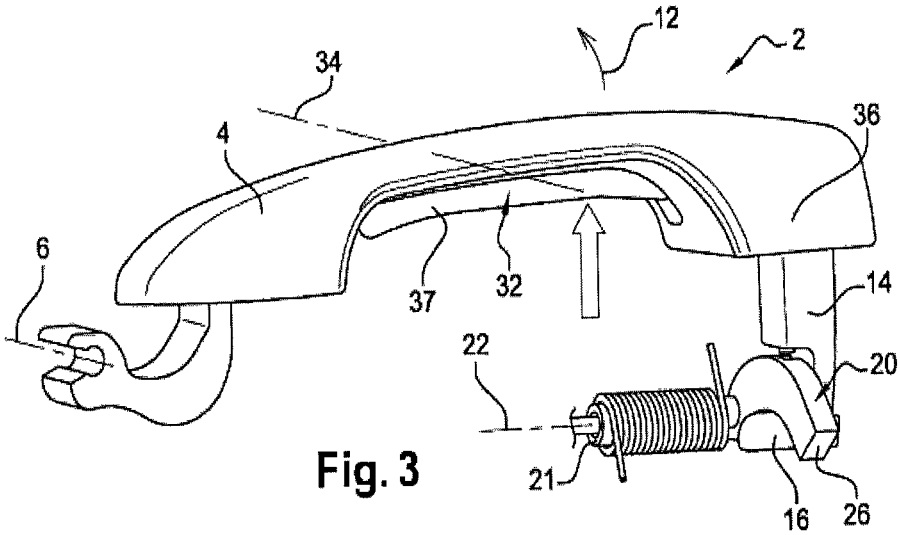
FIG. 3 is a view similar to FIG. 1, showing the handle during unlocking of the door.

The catch comprises a blocking finger 36 forming a bolt and extending through the arm 14 and as far as into the cavity 18. The bolt 36 is connected to a main body 37 of the catch 32 so as to be able to slide in a horizontal direction parallel to the Y direction and coincident with the axis 31 of the orifice 30 when the lever 20 is in the rest position. In the rest position, as illustrated in FIG. 1, the bolt 36 crosses the cavity 18 and extends into the orifice 30 of the continuation 26 thereby forming a catch. In the unblocked position as illustrated in FIG. 3, the catch 32 keeps the bolt 36 out of the strike 30 and out of the cavity 18.

The other parts of the handle, notably those situated downstream of the drive train, are of a conventional type.

The handle 2 works as follows.

In the handle rest position, the components occupy their rest position illustrated in FIG. 1. The door is in the closed position locked to the rest of the structure of the vehicle. The bolt 36 extends into the strike 30. It thus prevents any movement of the lever 20 that it blocks rigidly in position. The hook 16 is engaged with the continuation 26 of the lever 20. Operation of the handle is thus blocked unless the user commands its unblocking so that he can unlock it. If the graspable part of the handle 4 experiences a sudden deceleration as the result of an accident, movement thereof is rendered impossible by its connection to the lever 20 which is itself blocked in position.

In order to open the door, with reference to FIG. 3, the user grasps both the graspable part of the handle 4 and the catch 32 in his hand directly, slipping his fingers through the opening formed by the window 10. This grasping action first of all causes the catch 32 to rotate about its axis in the direction of the arrow 12. During the course of this movement, the catch carries with it the bolt 36 which leaves the strike 30 and the cavity 18, thus freeing the lever 20. During the continuation of the movement, the user moves the graspable part of the handle 4 in the direction of the arrow 12 so that the hook 16 pulls the continuation 26 in the Y direction in order to cause the lever 20, which is now free to turn, to rotate. This lever pulls the cable to transmit, to the other drive train components situated downstream, the command to unlock the door. Once this unlocking has been achieved, the door can be operated and opened by the user.

Figure 4:
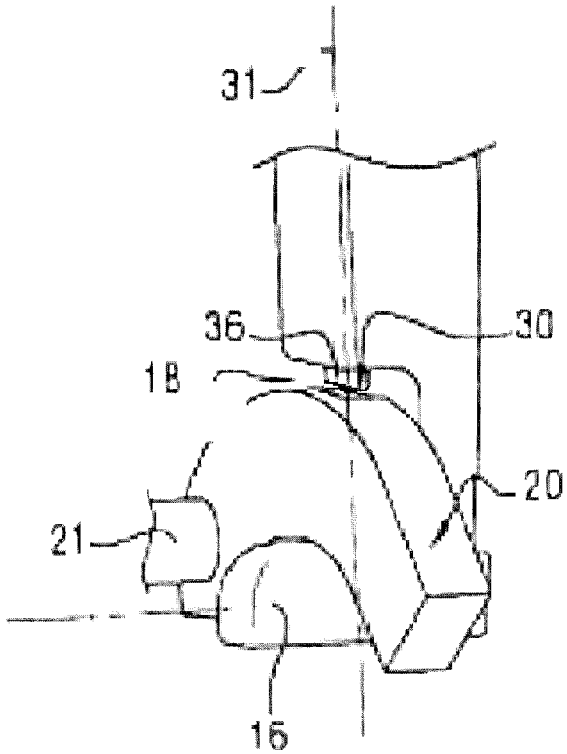
FIG. 4 is an enlarged view of FIG. 3, showing the handle in the unlocked position.

FIG. 4 shows the disengagement of the blocking finger 36 from the lever 20 when the apparatus is in the unlocked position.

The handle according to the invention does not require the installation of an inertial mass, which is in fact absent in this embodiment.

Of course, numerous modifications could be made to the invention without departing from the scope thereof.

The invention claimed is:

1. A vehicle door handle, comprising:

an actuator for operation of a vehicle door latch, the actuator being mounted such that the actuator moves between an actuator rest position and an actuator active position that is a door unlocking position;

a graspable part of the door handle mounted such that it can rotate about an axis and said graspable part comprising an elongated arm driving the actuator; and a blocking member arranged so as to occupy a blocking member rest position in which the blocking member blocks the actuator in the actuator rest position, wherein the blocking member extends through and is movable relative to the elongated arm, and wherein the handle is arranged such that, in the blocking member rest position, the blocking member enters the actuator, a graspable unblocking control member connected to the blocking member, wherein the graspable unblocking control member is configured to move the blocking member out of the blocking member rest position when the graspable unblocking control member is grasped.

2. The handle as claimed in claim 1, which is arranged such that, in the blocking member rest position, the blocking member enters a circumferential face of the actuator.

3. The handle as claimed in claim 1, wherein the blocking member is mounted to slide in a direction at right angles to a rotational axis of the actuator.

4. The handle as claimed in claim 3, in which the sliding direction is horizontal.

5. The handle as claimed in claim 3, wherein the sliding direction is perpendicular to a general plane of contact between a graspable part of the handle and a door of the vehicle.

6. The handle as claimed in claim 1, wherein the handle is arranged such that the graspable part of the handle is engaged with the actuator in any position of the graspable part of the handle and of the actuator.

7. The handle as claimed in claim 1, further comprising a graspable part of the handle having a window in which the unblocking control member extends.

8. The handle as claimed in claim 1, wherein, for unlocking, the handle comprises a cable actuated by the actuator for transmitting an unlocking command.

9. The handle as claimed in claim 1, wherein the actuator is a lever and the blocking member is a bolt.

* * * * *